US007303173B2

(12) United States Patent
Mileos

(10) Patent No.: US 7,303,173 B2
(45) Date of Patent: Dec. 4, 2007

(54) SHELF ADJUSTMENT MECHANISM

(75) Inventor: George Mileos, Riverdale, NY (US)

(73) Assignee: Humanscale Corporation, New York, NY (US)

( * ) Notice: Subject to any disclaimer, the term of this patent is extended or adjusted under 35 U.S.C. 154(b) by 0 days.

(21) Appl. No.: 10/737,040

(22) Filed: Dec. 15, 2003

(65) Prior Publication Data

US 2004/0227044 A1 Nov. 18, 2004

(51) Int. Cl.
*E04G 3/00* (2006.01)

(52) U.S. Cl. ..... 248/276.1; 248/225.11; 248/284.1; 248/292.14

(58) Field of Classification Search ..... 248/286.1, 248/284.1, 279.1, 274.1, 285.1, 280.11, 118, 248/118.3, 917, 918, 281.11, 225.1, 223.41, 248/276.1, 283.1, 292.13, 292.14; 108/136, 108/138, 140

See application file for complete search history.

(56) References Cited

U.S. PATENT DOCUMENTS 5,443,237 A * 8/1995 Stadtmauer ..... 248/441.1
5,924,664 A * 7/1999 Mileos et al. ..... 248/281.11
6,116,557 A * 9/2000 Choy et al. ..... 248/286.1
6,257,538 B1 * 7/2001 Pangborn et al. ..... 248/284.1
6,270,047 B1 * 8/2001 Hudson ..... 248/286.1
6,398,176 B1 * 6/2002 Liu ..... 248/284.1
6,488,248 B1 * 12/2002 Watt et al. ..... 248/279.1

FOREIGN PATENT DOCUMENTS

JP 10-323236 * 12/1998

* cited by examiner

*Primary Examiner*—Carl D. Friedman
*Assistant Examiner*—Tan Le

(57) ABSTRACT

The present invention concerns a mechanism for adjusting the angle of an auxiliary support mounted on an auxiliary support mechanism. The mechanism may have a first member having a plurality of surfaces mounted on the end of an auxiliary support mechanism. The mechanism may also have a second member having a plurality of surfaces slideably enveloping said first member. The mechanism may still further have a third member movably connected to the auxiliary support mechanism as well as a spring member.

1 Claim, 17 Drawing Sheets

SHELF ADJUSTMENT MECHANISM

BACKGROUND OF THE INVENTION

This invention relates to an auxiliary support mechanisms, such as those used to support the keyboard of a personal computer. The present invention permits the angle of the auxiliary work surface to be adjusted to improve the ergonomics of the work surface.

FIELD OF THE INVENTION

Personal Computers (PCs) have become ubiquitous in many industry and office environments. The input means most commonly used appears to be the keyboard. However, it is generally thought that use of a keyboard that is not positioned properly can lead to repetitive motion injury such as carpal tunnel syndrome. Thus, it is important to be able to properly position the keyboard.

One line of advances was the development of the auxiliary support mechanisms to position, for instance, a keyboard where a PC user would find it convenient. The earliest of these was developed by Hannah et al. (U.S. Pat. No. 4,826,123) and used a four-bar parallelogram linkage. Another approach was that of McConnell (U.S. Pat. No. 5,257,767) which used a four-bar non-parallelogram trapezoidal linkages. Yet another distinctly different approach to positioning, for instance, a keyboard, was my own development (U.S. Pat. No. 5,924,664) which used a five-bar mechanism including a slider joint.

Some keyboard support surfaces heretofore available have incorporated a tilt adjustment device allowing the keyboard support surface to be adjusted over a range of tilt angles. For instance, U.S. Pat. No. 6,148,739 to Martin, U.S. Pat. No. 6,135,405 to Jones et al., U.S. Pat. No. 5,961,231 to Ambrose, U.S. Pat. No. 5,775,657 to Hung, U.S. Pat. No. 5,704,299 to Corpuz, Jr., et al., and U.S. Pat. No. 5,692,712 to Weinschenk, Jr., et al. Nonetheless, the range of available tilt angles available has been limited.

Ergonomists advise us that the lowest risk of repetitive motion injury occurs when the keyboard angle is slightly negative so that the bottom of the front edge (i.e, the edge of the keyboard closest to the user) of the keyboard is higher than the bottom of the rear edge (i.e, the edge of the keyboard furthest from the user) of the keyboard. Accordingly, there was a need for a shelf adjustment mechanism that provides an improved means of achieving the ergonomically desired negative tilt.

BRIEF SUMMARY OF THE INVENTION

One aspect of the present invention is to provide an adjustable support for computer keyboards and the like. In such an embodiment, the adjustable support may include a support member shaped to retain an associated keyboard thereon. The support member may be pivotally mounted to shift about a generally horizontal pivot axis to define a tilt angle for the support member and the keyboard with respect to a user, wherein the tilt angle is adjustable within a predetermined tilt range. Desirably, the tilt angle is adjustable between +10/−25 about 0 and −15° relative to horizontal.

DETAILED DESCRIPTION OF THE INVENTION

Figure 1:
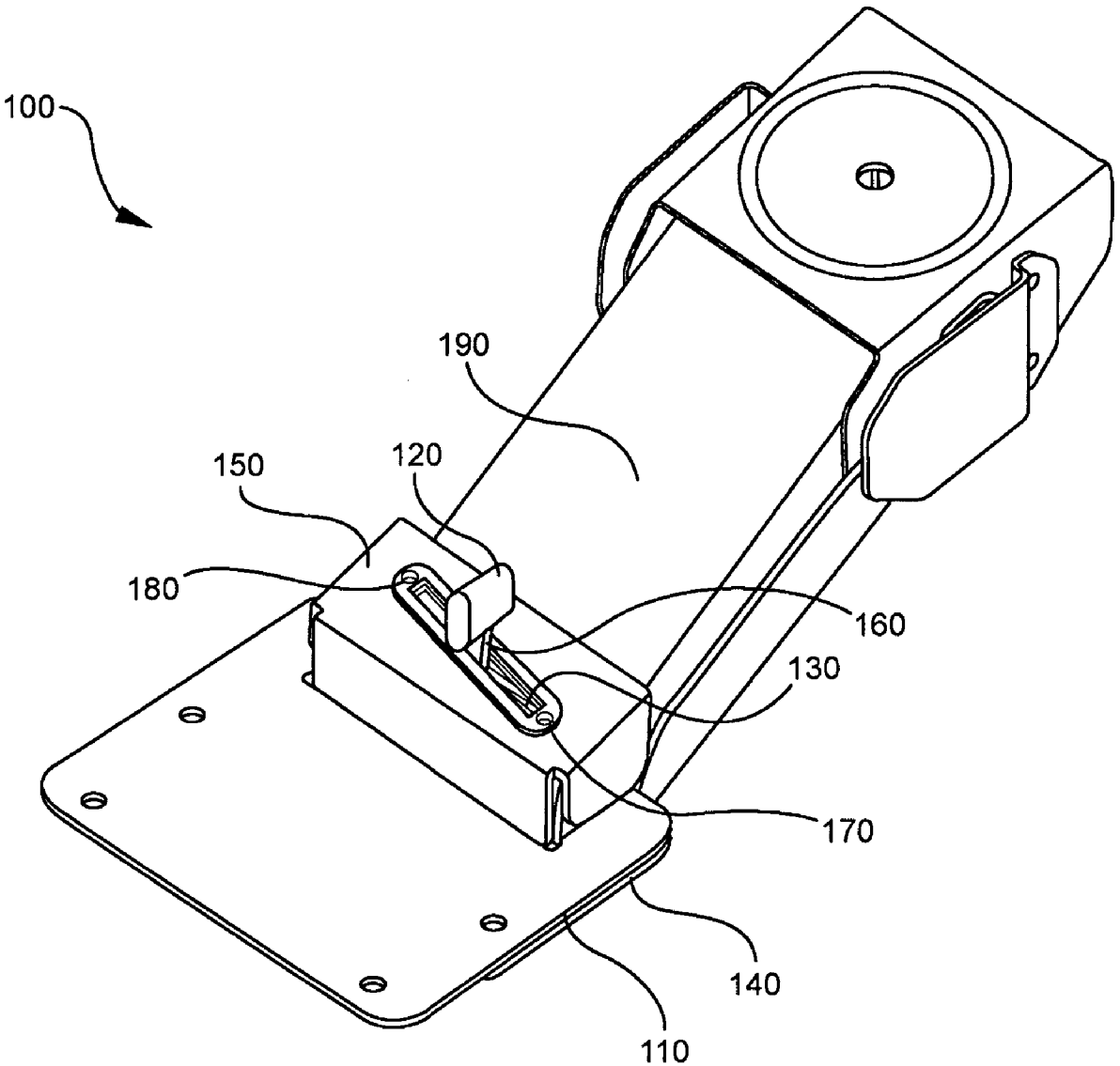
FIG. 1 is a perspective view of a shelf adjustment mechanism for an adjustable support for keyboards and the like embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Additionally, unless the context requires otherwise, similarly numbered parts in the several drawings are intended to correspond.

Turning to FIG. 1, the adjustable support mechanism 100 to which the shelf adjustment mechanism of the present invention can be incorporated includes substantially any conventional adjustable support mechanism. For instance, the adjustable support mechanism could be any of the three dramatically different styles exemplified by the parallelogram linkage of Hannah et al. (U.S. Pat. No. 4,826,123), the four-bar non-parallelogram trapezoidal linkage of McConnell (U.S. Pat. No. 5,257,767), or my five-bar mechanism including a slider joint (U.S. Pat. No. 5,924,664).

FIG. 1 also shows knob 120 which moves bar 160 within slot 130. Slot 130 is situated in the top surface of box member 150. Box member 150 is attached to platform support 110, and in turn pivotal member 140.

Figure 2:
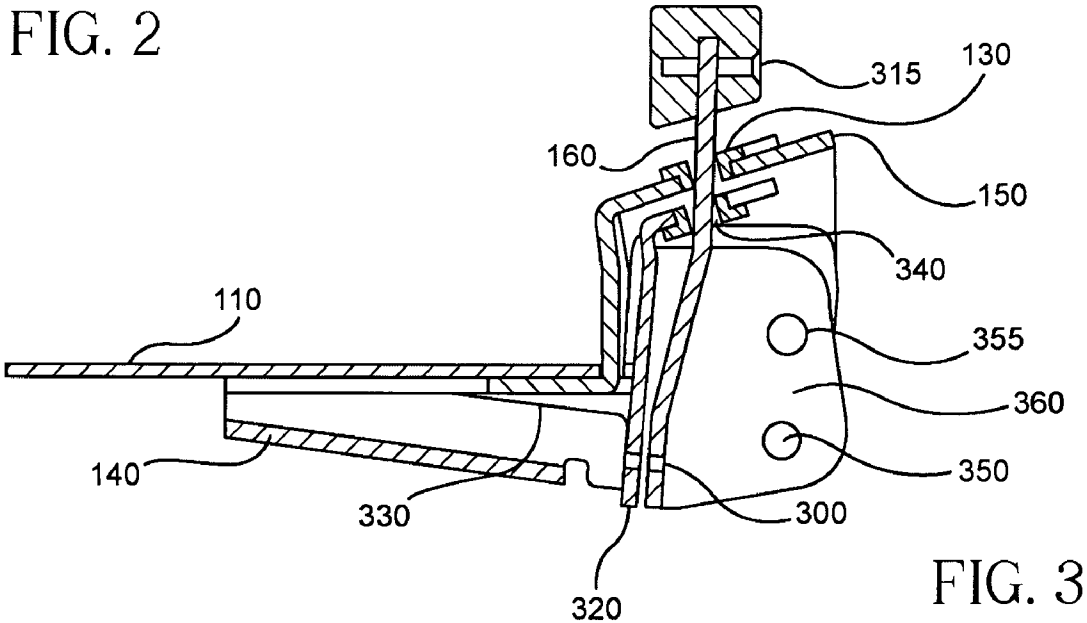
FIG. 2 is a top view of a shelf adjustment mechanism for an adjustable support for keyboards and the like embodying the present invention.

FIG. 2 provides a top view of a preferred embodiment of the adjustment mechanism of the present invention. FIG. 2 thus shows knob 120 which moves within slot insert 130 from above. Slot insert 130 is situated in the top surface of box member 150 and is generally of a diagonal orientation. In the embodiment of the present invention illustrated in FIG. 2, the slot insert 130 (and thus the corresponding slot) is much closer to point 210 on the front surface of box member 150 that slot insert 130 (and thus the corresponding slot) is to point 220 on the front surface of box member 150.

Again, in FIG. 2, box member 150 is preferably welded to platform support 110.

Figure 3:
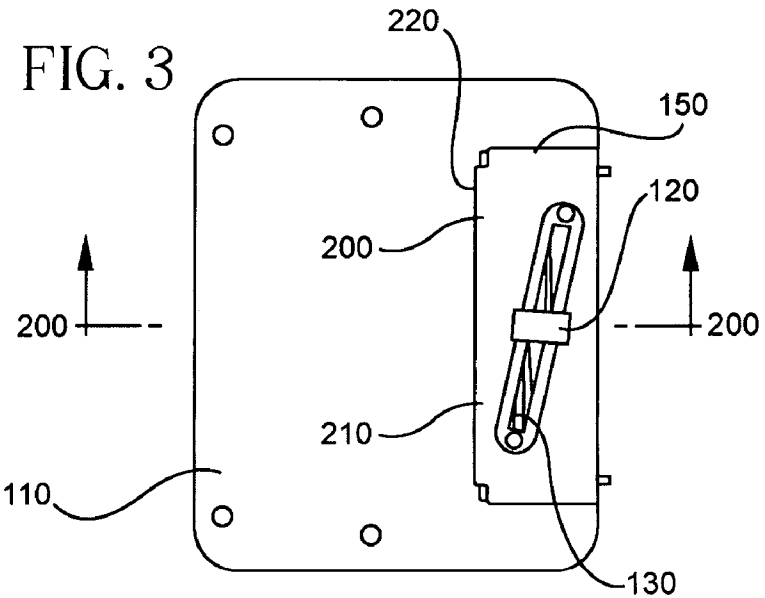
FIG. 3 is a cross-sectional view of the shelf adjustment mechanism of FIG. 2 taken along line 200-200.

FIG. 3 provides a cross-sectional view of the mechanism of FIG. 2 taken along line 200-200. FIG. 3 reveals that knob 120 is mounted on bar 160. This mounting is secured by mounting means 315, which typically can be a screw, a rivet, an adhesive, or any other conventional mechanical or chemical means of securing two components, or alternatively, knob 120 can be an integral structure of bar 160.

Also seen in FIG. 3 is the support connecting member 360 which is joined to support 100 (not shown in this FIG.) by pivot axes that pass through apertures 350 and 355. Pivotal member 140 is also connected to support 100 by the pivot axis that passes through aperture 350. Mounted on top of pivotal member 140 is support member 110.

Bar 160 runs from knob 120 through slot insert 130 in box member 150, through slot insert 340 in support connecting member 360, and to pivot connection 300 which connects bar 160 pivotally to support connecting member 360. In a particularly preferred embodiment of the present invention, bar 160 is separated from support connecting member 360 by a washer 320. It is further preferred that washer 320 is fabricated from a plastic such as palycarbonate so as to provide a frictional resistance to the movement of bar 310.

Also shown in FIG. 3 is a spring member 330 which generally urges the support platform assembly into a preset neutral position. Desirably, spring member 330 has sufficient force to resist the deformation caused by placing an average weight keyboard on the auxiliary platform without pushing the keyboard into the steepest negative keyboard angle that can be achieved by the mechanism.

Figure 6:
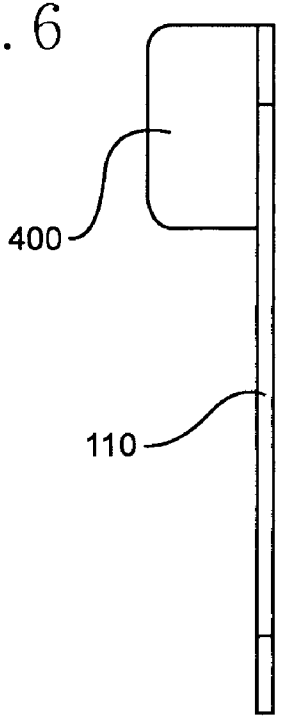
FIG. 6 is a side view of a top member for an auxiliary shelf mounting surface for an embodiment of the present invention.
Figure 4:
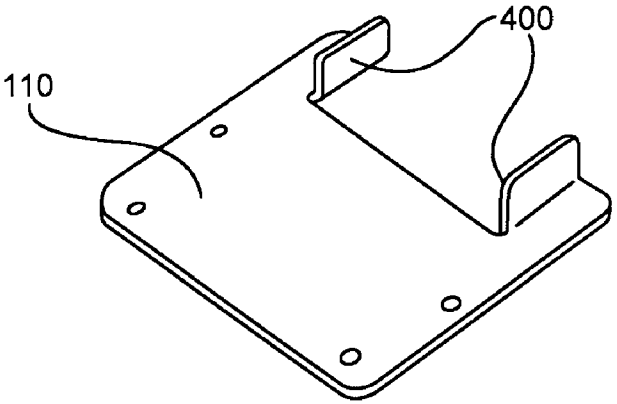
FIG. 4 is a perspective view of a top member of an auxiliary shelf mounting surface for an embodiment of the present invention.
Figure 5:
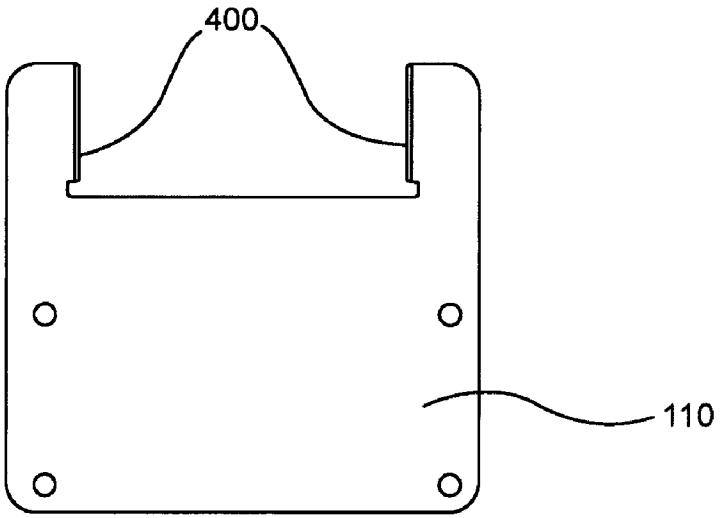
FIG. 5 is a top view of a top member for an auxiliary shelf mounting surface for an embodiment of the present invention.

FIG. 4 shows the top perspective of platform support 110 and flanges 400, which flanges were concealed in FIG. 1 whereas FIG. 5 shows the top view of, and FIG. 6 shows a side view of, platform support 110.

Figure 8:
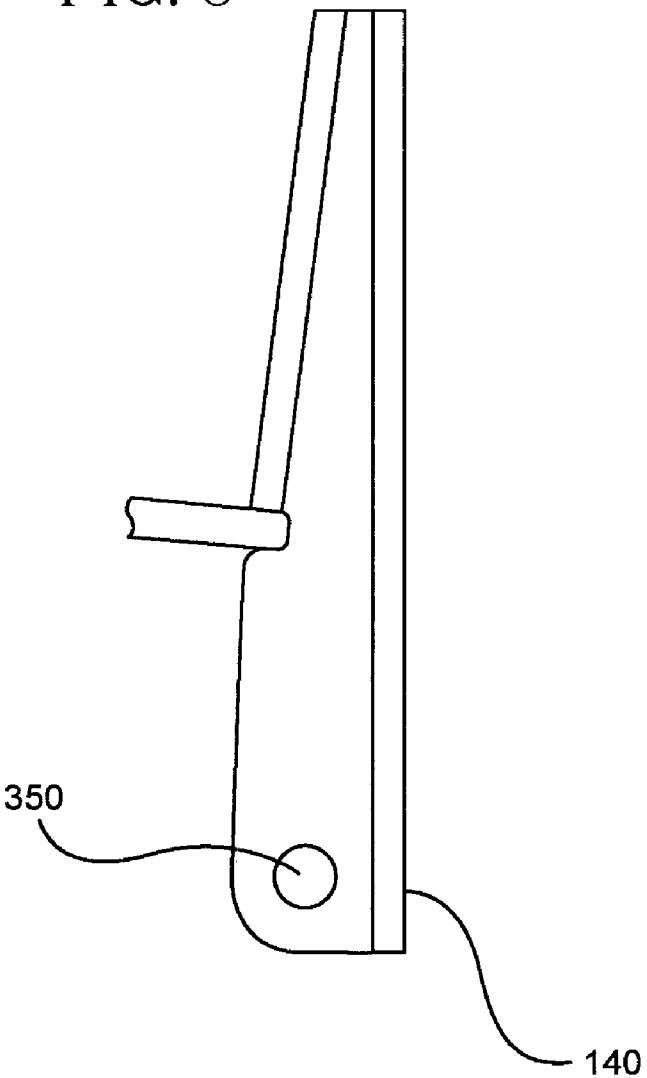
FIG. 8 is a side view of a pivoting member for an auxiliary shelf mounting surface for an embodiment of the present invention.
Figure 7:
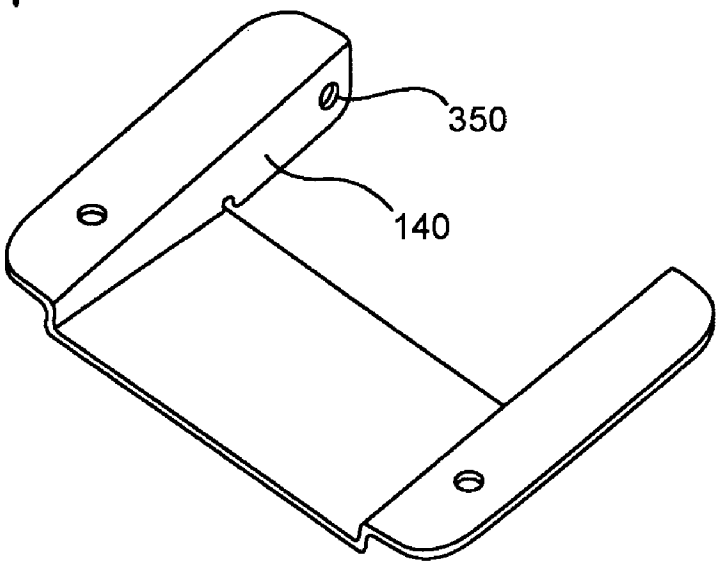
FIG. 7 is a perspective view of a pivoting member of an auxiliary shelf mounting surface for an embodiment of the present invention.
Figure 9:
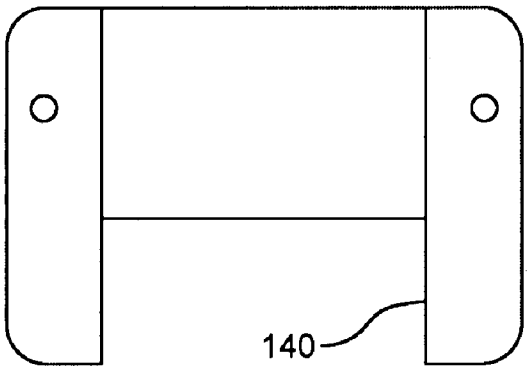
FIG. 9 is a top view of a pivoting member for an auxiliary shelf mounting surface for an embodiment of the present invention.

FIG. 7 shows the top perspective of pivotal member 140 and apertures 350 on each side of pivotal member 140 for pivotally mounting pivotal member 140 to support connecting member 360. FIG. 8 shows the side view of, and FIG. 9 shows a top view of, pivotal member 140.

Figure 11:
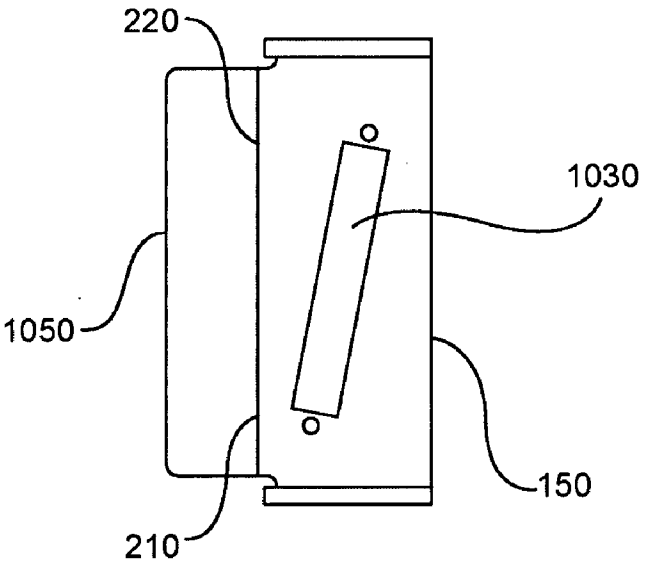
FIG. 11 is a top view of a first slotted member of an auxiliary shelf mounting surface for an embodiment of the present invention.
Figure 10:
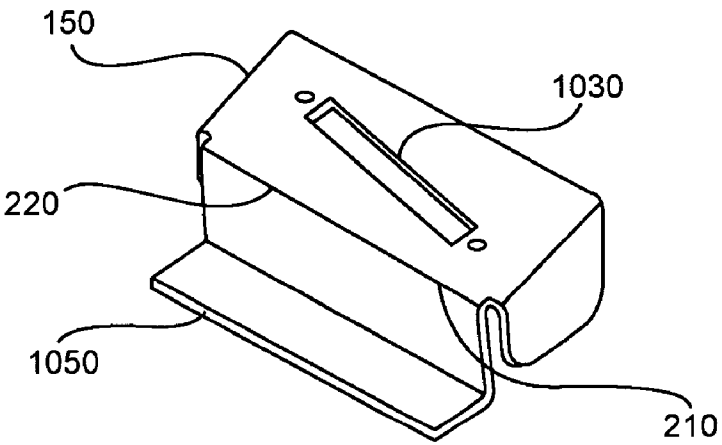
FIG. 10 is a perspective view of a first slotted member of an auxiliary shelf mounting surface for an embodiment of the present invention.
Figure 12:
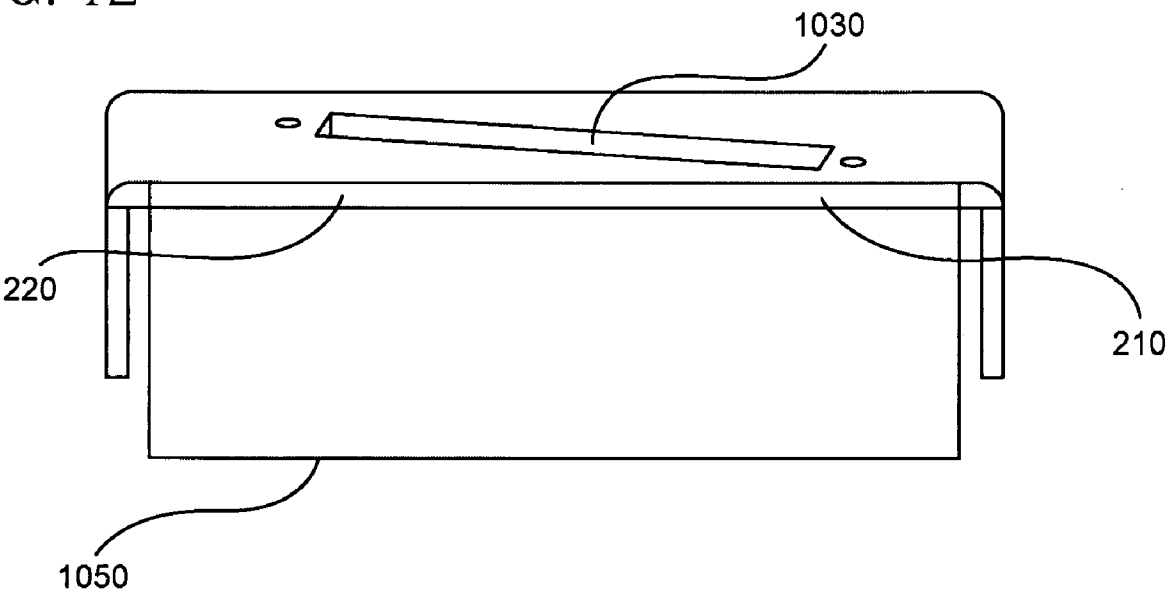
FIG. 12 is a front view of a first slotted member of an auxiliary shelf mounting surface for an embodiment of the present invention.
Figure 13:
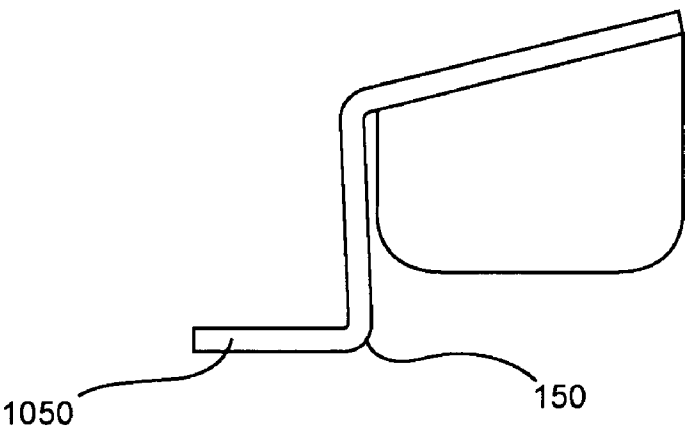
FIG. 13 is a side view of a first slotted member of an auxiliary shelf mounting surface for an embodiment of the present invention.

FIG. 10 provides a prospective view of a preferred embodiment of box member 150 with slot 1030 into which slot insert 130 is to be placed. FIGS. 11, 12 and 13 show, respectively, a top, front and side view of box member 150, and in FIGS. 11 and 12, slot 1030. Also visible in FIGS. 10, 11, 12 and 13 is foot member 1050 of box member 150.

Figure 16:
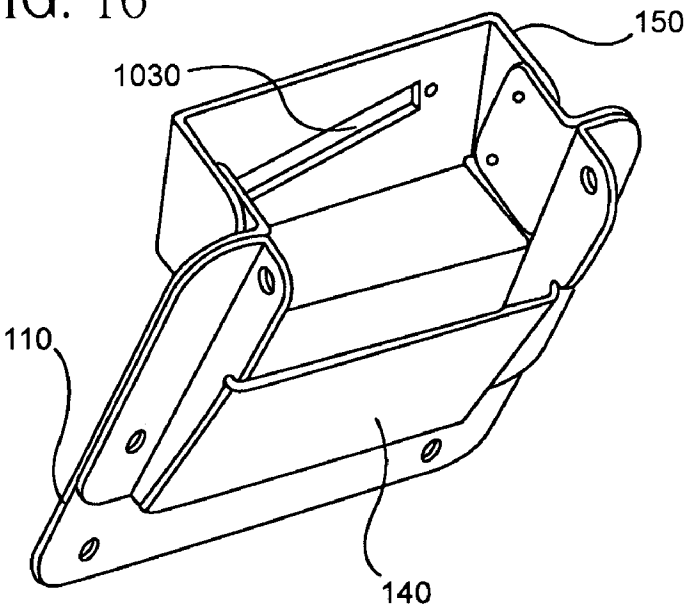
FIG. 16 is a rear perspective view of an assembly of a top member, a pivoting member and a first slotted member of an auxiliary shelf mounting surface for an embodiment of the present invention.
Figure 14:
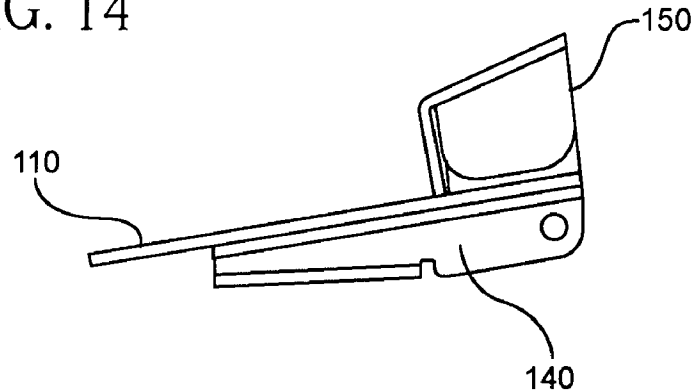
FIG. 14 is a side view of an assembly of a top member, a pivoting member and a first slotted member of an auxiliary shelf mounting surface for an embodiment of the present invention.
Figure 15:
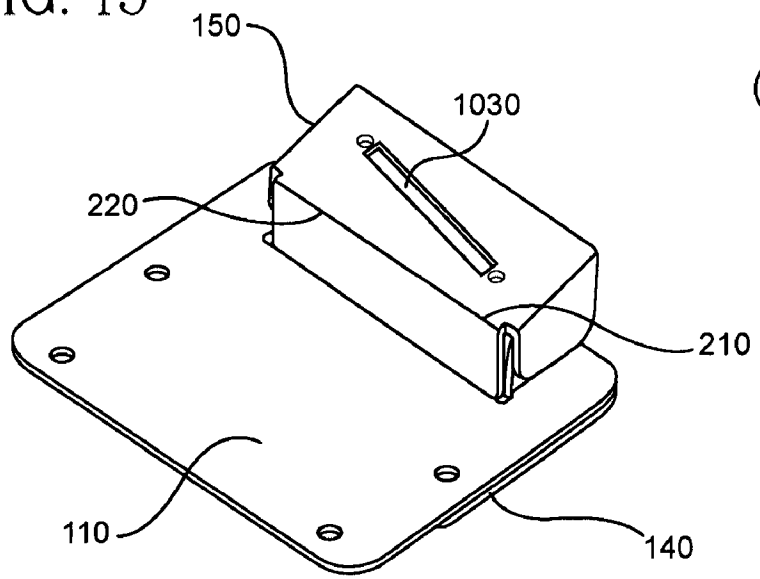
FIG. 15 is a side perspective view of an assembly of a top member, a pivoting member and a first slotted member of an auxiliary shelf mounting surface for an embodiment of the present invention.

FIGS. 14, 15 and 16 show, respectively a side, top perspective and rear perspective view of an assembly including platform support 110; pivotal member 140, and box member 150. Note that foot member 1050 of box member 150 sits below platform support 110.

Figure 17:
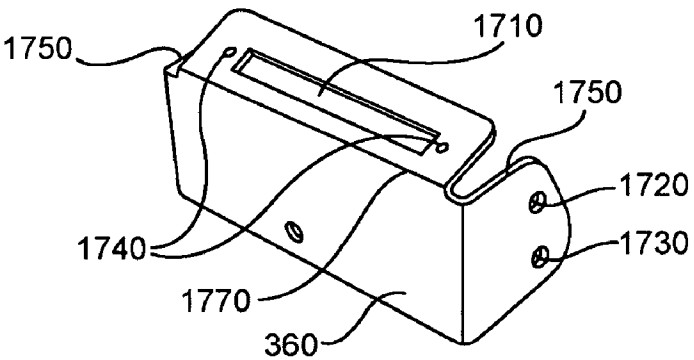
FIG. 17 is a perspective view of a second slotted member of an auxiliary shelf mounting surface for an embodiment of the present invention.

FIGS. 17, 18, 19 & 20 show various aspects of support connecting member 360. Specifically, FIG. 17 shows a prospective view of support connecting member 360 and illustrates left and right flanges 1750 having apertures 1720 & 1730 which admit pivot axes that connect support 100 to the shelf adjustment mechanism of the present invention in this embodiment. FIG. 17 further shows slot 1710 and apertures 1740 through which the upper and lower slot inserts are connected.

Figure 18:
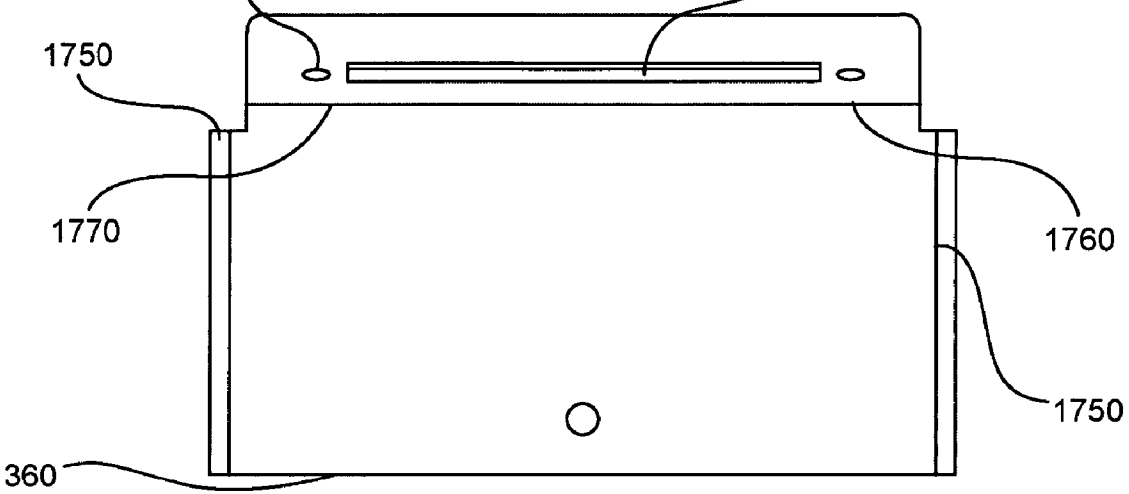
FIG. 18 is a front view of a second slotted member of an auxiliary shelf mounting surface for an embodiment of the present invention.
Figure 19:
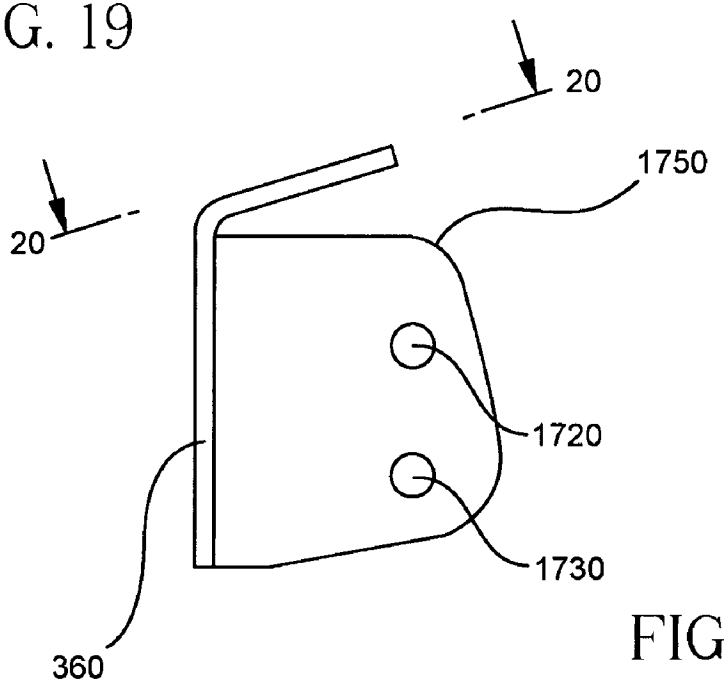
FIG. 19 is a side view of a second slotted member of an auxiliary shelf mounting surface for an embodiment of the present invention.

FIG. 18 shows a frontal view of support connecting member 360 with left and right flanges 1750 as well as slot 1710 and apertures 1740. FIG. 19 shows a side view of support connecting member 360 with a side flange 1750 having apertures 1720 & 1730.

In the embodiment of the present invention illustrated in FIGS. 17 & 18, slot 1710 is substantially parallel to the front edge of support connecting member 360 so that the shortest distance between slot 1710 and point 1760 on the front edge of support connecting member 360 is substantially the same distance as the shortest distance between slot 1710 and point 1770 on the front edge of support connecting member 360.

Figure 20:
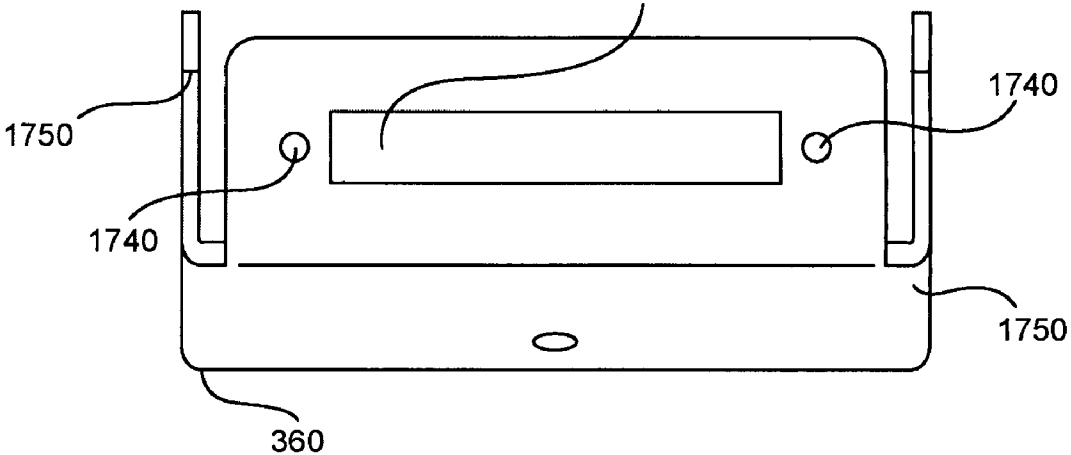
FIG. 20 is a top view of a second slotted member of an auxiliary shelf mounting surface for an embodiment of the present invention taken along line 20-20.

FIG. 20 is a view taken along line 20-20 in FIG. 19 and provides a top down view of connecting member 360 with left and right flanges 1750 as well as slot 1710 and apertures 1740.

Figure 22:
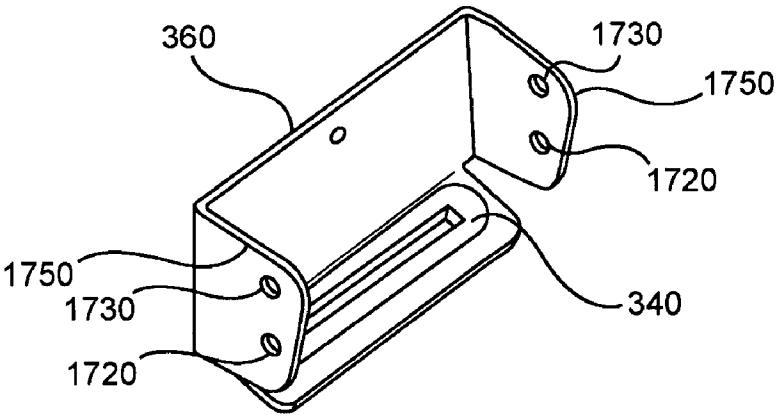
FIG. 22 is a rear perspective view of a second slotted member of an auxiliary shelf mounting surface for an embodiment of the present invention and a slot insert.
Figure 21:
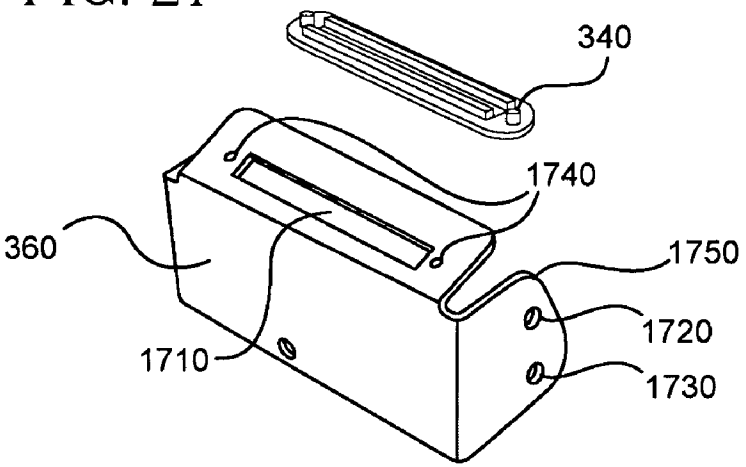
FIG. 21 is an exploded perspective view of a second slotted member of an auxiliary shelf mounting surface for an embodiment of the present invention and a slot insert.
Figure 23:
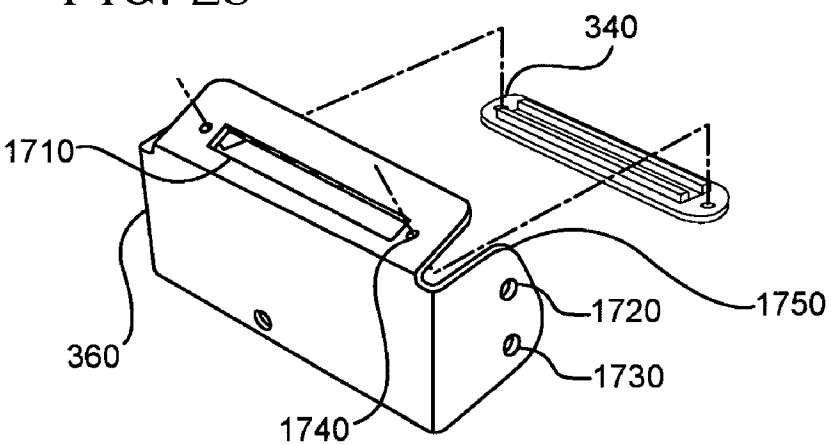
FIG. 23 is an exploded perspective view of a second slotted member of an auxiliary shelf mounting surface for an embodiment of the present invention and an alternative slot insert.

FIGS. 21, 22 & 23 show connecting member 360 and the placement of slot inserts 340 into slot 1710 in connecting member 360. These figures also illustrate side flanges 1750 and their associated apertures 1720 & 1730.

In the operation of the embodiment of the present invention illustrated in FIGS. 1-23, the movement of knob 120, and thus bar 160, toward point 170 of FIG. 1 causes box member 150 to move toward point 190 relative to support connecting member 360, which is under box member 150. This motion of box member 150—which shortens the distance between bar 160 and support member 110—effectively lifts the front edge of support member 110 and increases any "negative angle". Conversely, the movement of knob 120, and thus bar 160, toward point 180 of FIG. 1 causes box member 150 to move away from point 190 relative to support connecting member 360, which is under box member 150. This motion of box member 150—which lengthens the distance between bar 160 and support member 110—effectively pushes the front edge of support member 110 down, thereby decreasing the "negative angle" of the mechanism.

The motion of bar 160 between points 170 and 180 in FIG. 1 causes knob 120 to travel in an arc. In an alternative embodiment of the present invention, knob 120 is replaced with a cover mechanism that slides along the top surface of box member 150. Desirably, this cover mechanism can accommodate the variable amount of bar 160 that projects above the top surface of box member 150 and thus this cover mechanism increases or decreases the "negative angle" of the support shelf without moving the cover mechanism out of contact with the top surface of box member 150.

In a further embodiment of the present invention bar 160 with its anchor 300 is replaced with a slide mechanism that travels in the slots. Desirably, the slide mechanism is substantially I shaped having a bottom portion that is too wide to permit the slide mechanism to rise up out of the slots and a top portion that is too wide to permit the slide mechanism to sink down and out of the slots. In a more preferred version of this embodiment of the present invention, the underside of the top portion of the support connecting member 360 about slot 1710 has a track that engages the bottom portion of the slide mechanism so as to further prevent the slide mechanism from moving out of the slots.

Functionally this slide mechanism is substantially the equivalent of the moving bar 160 mechanism in that when the slide mechanism is moved toward point 170 of FIG. 1, this movement of the slide mechanism causes box member 150 to move toward point 190 relative to support connecting member 360, which is under box member 150. Again, this motion of box member 150—shortens the distance between bar 160 and support member 110—effectively lifting the rear edge of support member 110 and reducing any "negative angle". Conversely, the movement of the slide mechanism toward point 180 of FIG. 1 causes box member 150 to move away from point 190 relative to support connecting member 360, which is under box member 150. This motion of box member 150—lengthens the distance between bar 160 and support member 110—effectively pushes the rear edge of support member 110 down, thereby increasing the "negative angle" of the mechanism.

While the mechanism of the present invention can be fabricated out of substantially any conventional materials, it is believed that if slot inserts 340 are made of plastic such as polycarbonate, there is an improvement in the performance of the device of the present invention. Similarly, a performance improvement was observed when bar 160 was made of steel and coated with black oxide. Likewise, if washer 320 is made of a plastic such as polycarbonate, the frictional interaction between washer 320 and bar 160 is increased so as to substantially reduce any "spontaneous" movement of bar 160 from an extreme position toward the center of the slot. It is also desired that spring member 330 is made of spring steel.

It is also desired that the lower portion of slot inserts 340 in support connecting member 360 are tapered outward so as to reduce frictional contact at that point between the slot inserts and bar 160.

Figure 24:
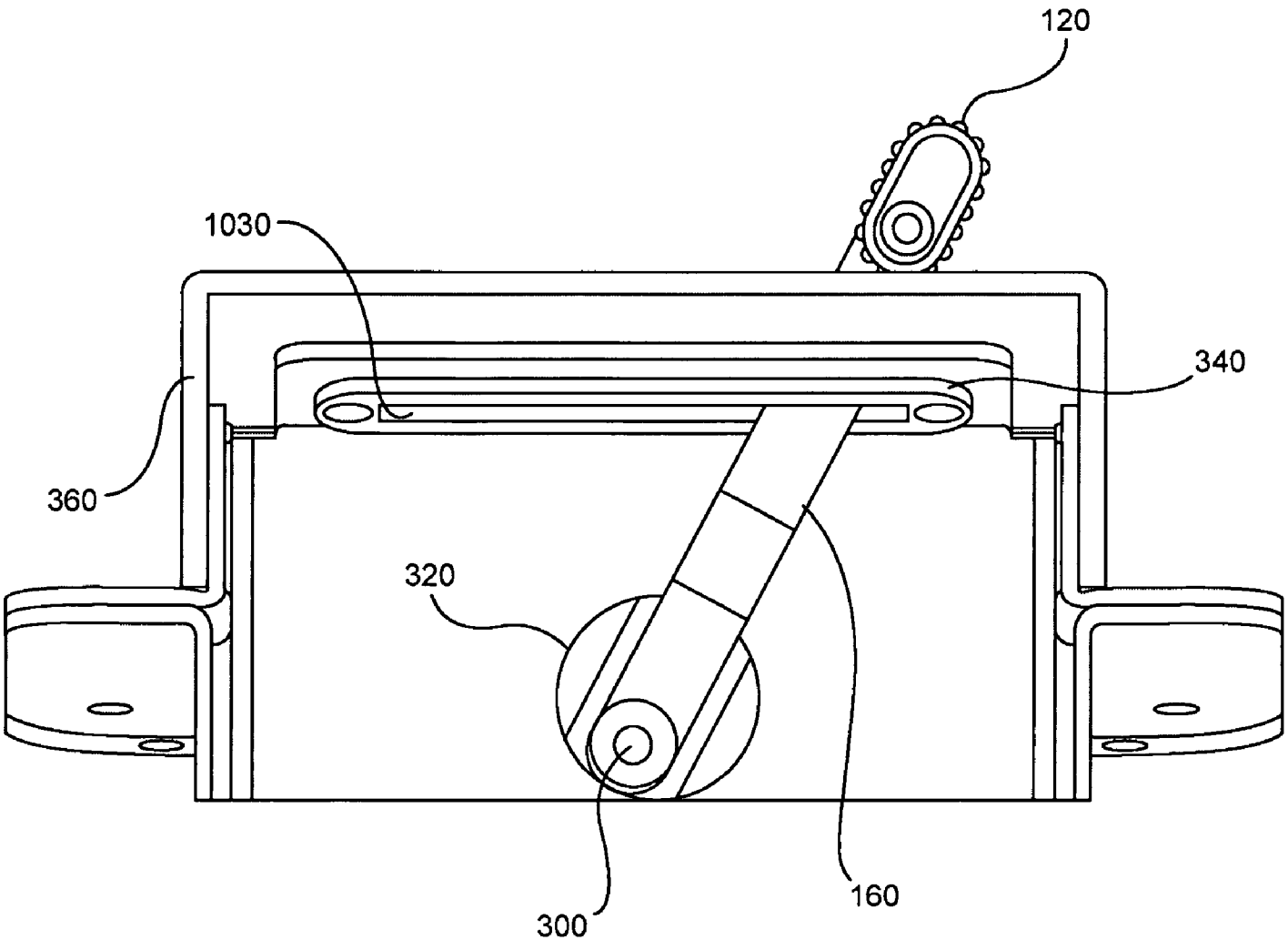
FIG. 24 is a rear view of an assembly of a top member and a pivoting member of a preferred embodiment of an adjustment mechanism of the present invention.

FIG. 24 illustrates a preferred embodiment of how bar 160 is pivotally connected to the inventive mechanism at pivot connection 300. As shown in FIG. 24, bar 160 projecting through slot 340 with knob 120 at its distal end. In the preferred embodiment of the present invention shown in FIG. 24, bar 160 is separated from support connecting member 360 by a washer 320.

Figure 25:
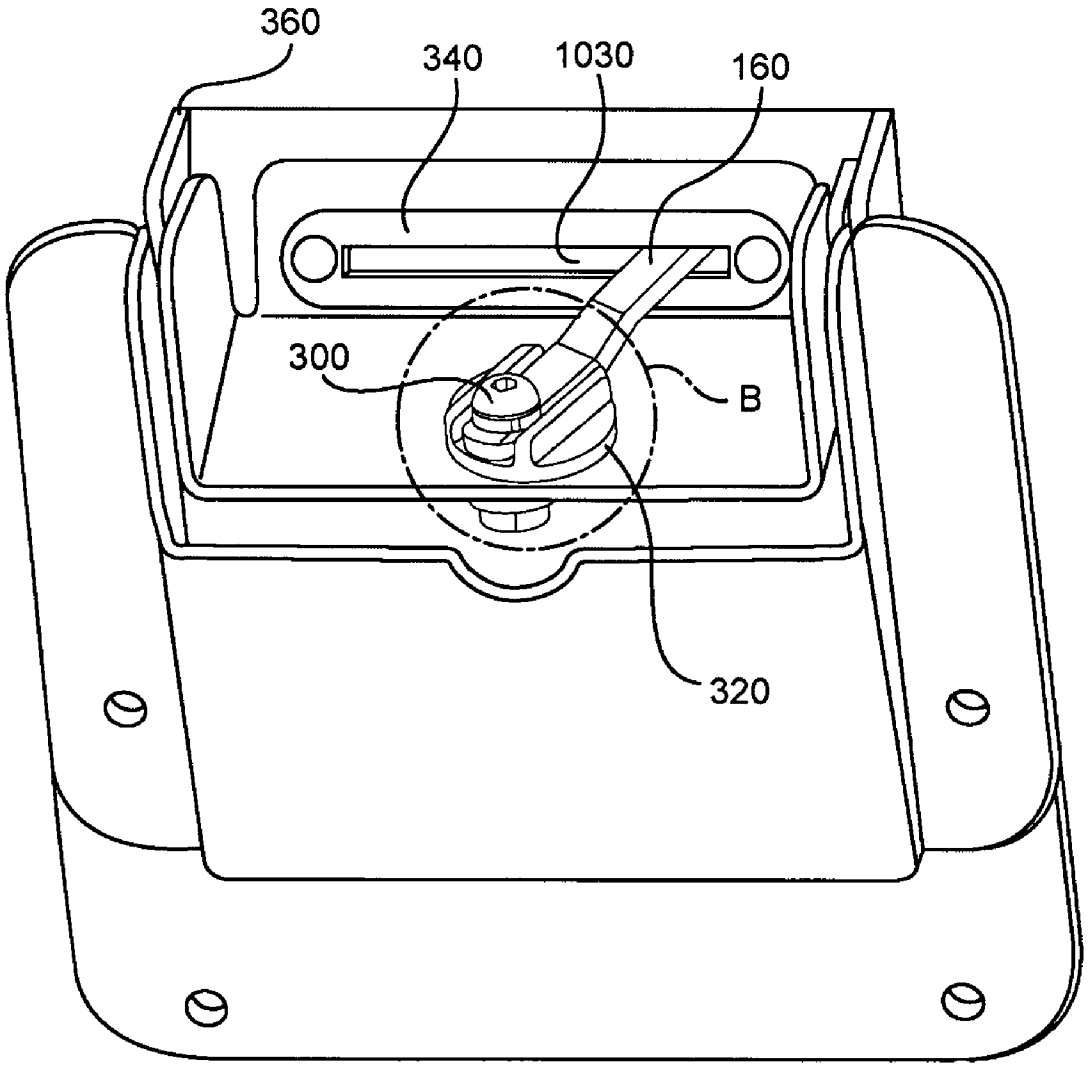
FIG. 25 is a perspective view, taken from below and behind, showing an assembly of a top member and a pivoting member of a preferred embodiment of an adjustment mechanism of the present invention.
Figure 26:
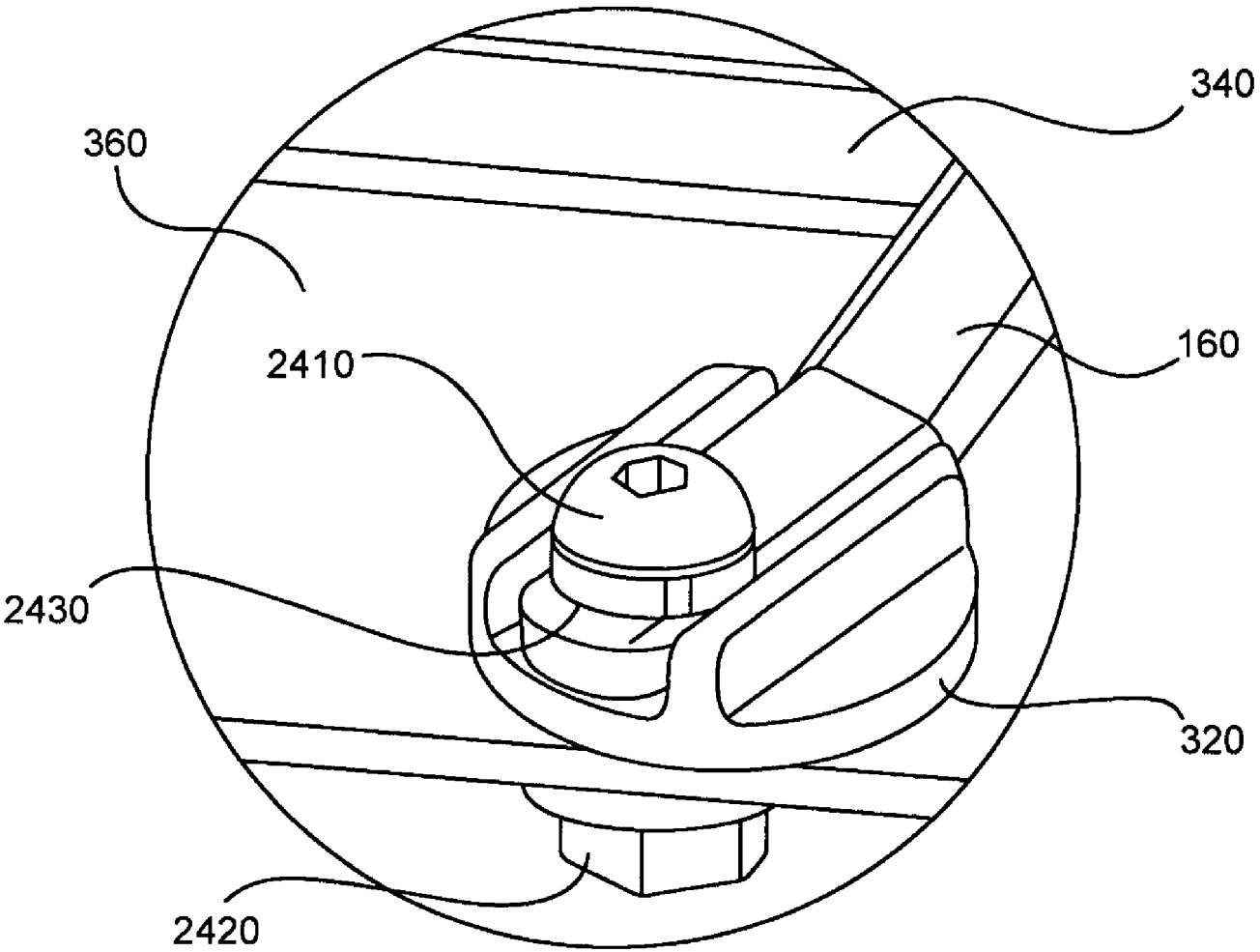
FIG. 26 is an enlarged view of the portion of FIG. 25 designated by circle B.

FIG. 25 shows pivot connection 300 from another perspective and identifies region B which is enlarged in FIG. 26. In FIG. 26, a preferred embodiment of pivot connection 300 can be seen in greater detail. Specifically, pivot connection 300, in this preferred embodiment, includes a machine screw 2410 that communicates through spring washer 2430 (for instance, a steel spring washer), bar 160 and support connecting member 360 to lock nut 2420 and secures bar 160 to support connecting member 360.

Figure 27:
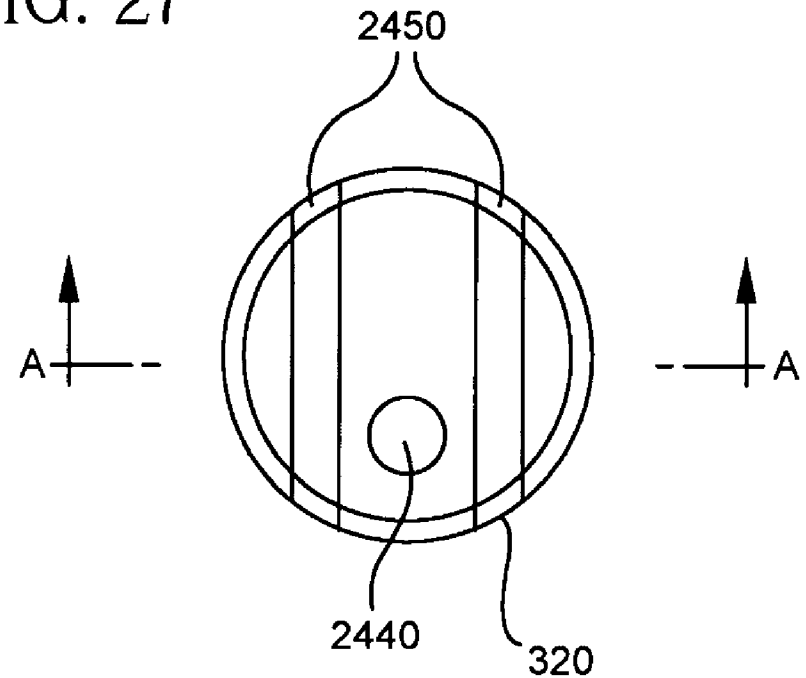
FIG. 27 is a top view of a molded washer useful in a preferred embodiment of the present invention.

FIG. 27 provides a top view of a particularly preferred embodiment of washer 320. In this embodiment, two parallel ridges 2450 are molded into washer 320. Also shown in this figure is washer aperture 2440, which is offset from the center of washer 320. but along a line that runs through the center of washer 320.

Figure 28:
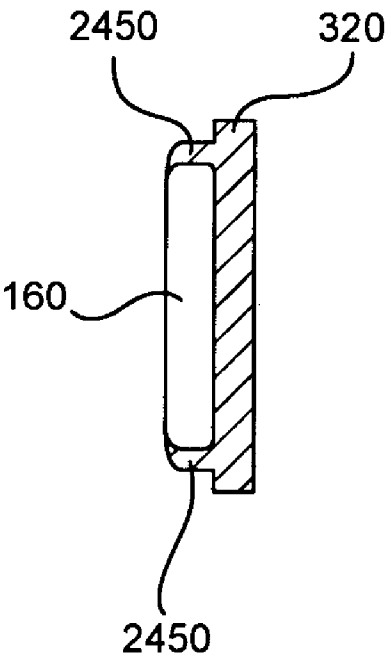
FIG. 28 is a side view of a molded washer useful in a preferred embodiment of the present invention.

FIG. 28 provides a side view of the preferred embodiment washer 320 shown in FIG. 27. In FIG. 28, bar 160 can be seen within the valley formed by parallel ridges 2450.

Figure 29:
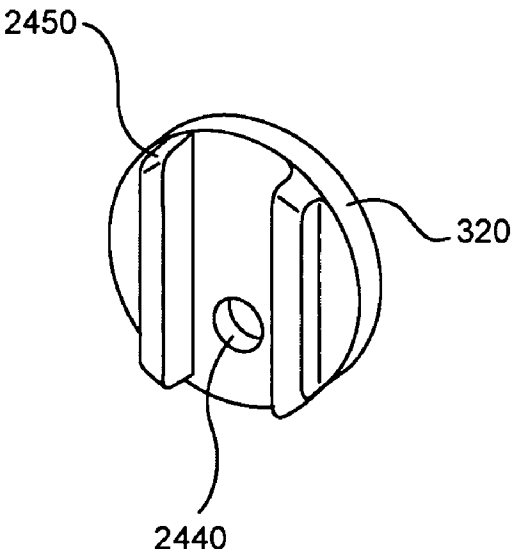
FIG. 29 is a perspective view of a molded washer useful in a preferred embodiment of the present invention.

FIG. 29 provides a further view of the preferred embodiment washer 320 shown in FIG. 27 from another perspective. Also seen in this view are washer aperture 2440 and parallel ridges 2450.

Figure 30:
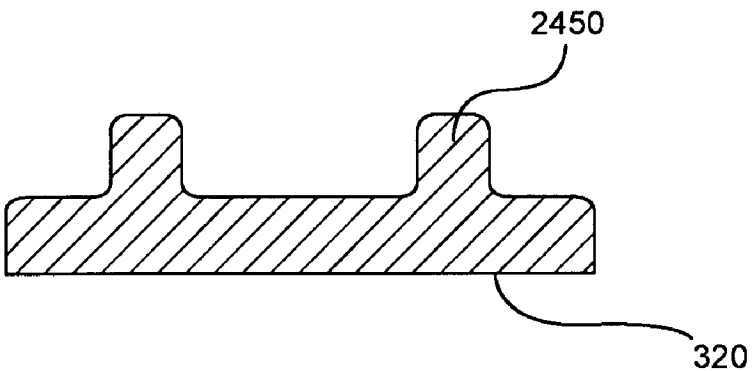
FIG. 30 is a cut-away view of the molded washer of FIG. 27 taken along line A-A.

FIG. 30 provides a cross-sectional view of washer 320 taken along line A-A in FIG. 27. This figure illustrates the valley formed by parallel ridges 2450 on washer 320.

Figure 31:
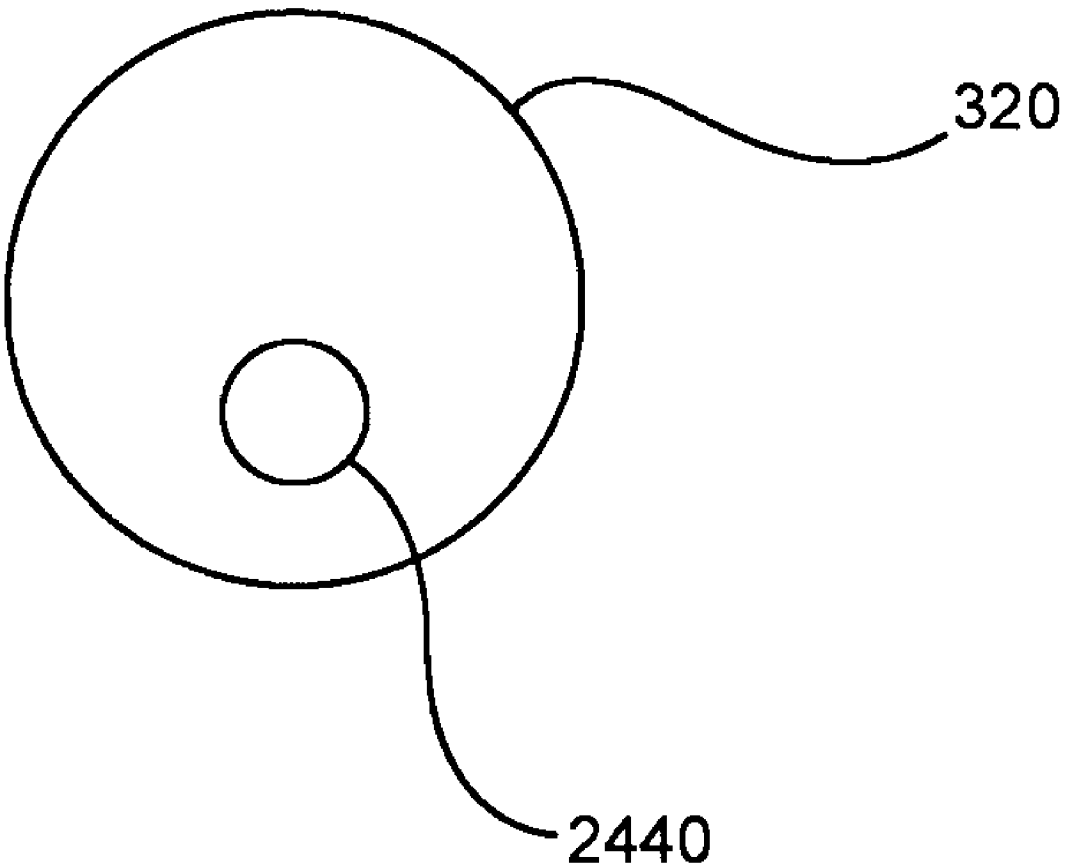
FIG. 31 is a rear view of a molded washer useful in a preferred embodiment of the present invention.
Figure 32:
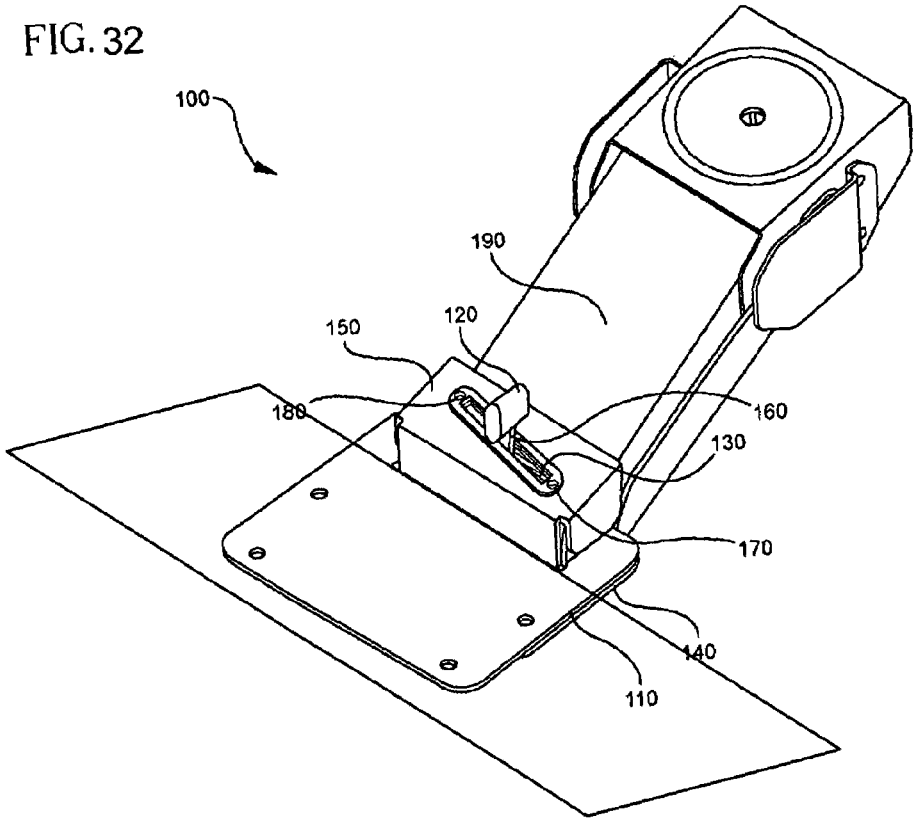
FIG. 32 is a perspective view of a shelf adjustment mechanism with an auxiliary shelf for an adjustable support for keyboards and the like embodying the present invention.

FIG. 31 provides a bottom view the preferred embodiment of washer 320 shown in FIGS. 27-30. This view shows washer aperture 2440, which is offset from the center of washer 320. but along a line that runs through the center of washer 320.

What I claim is:

1. An auxiliary shelf adjustment mechanism comprising:

A. a first member having a plurality of surfaces mounted on the end of an auxiliary support mechanism distal to a mounting member of the auxiliary support mechanism, said first member having a first elongated slot on one of said first member surfaces;

B. a second member having a plurality of surfaces slideably enveloping said first member, said second member having a second elongated slot on a surface said second member adjacent to the surface of said first member having said first elongated slot wherein one of said first and second elongated slots is substantially parallel to a surface of said second member and the other elongated slot substantially forms an acute angle with the substantially parallel slot;

C. a third member pivotally joined to (a) the end of an auxiliary support mechanism distal to the mounting member of the auxiliary support mechanism and (b) said first member, and said third member is movably attached to said second member; and D. a spring member mounted on said third member in a manner effective to urge said third member into a upward position.

* * * * *